United States Patent [19]

Greeno

[11] Patent Number: 4,944,521

[45] Date of Patent: Jul. 31, 1990

[54] WAR GAME MARKING GRENADE

[76] Inventor: Donald R. Greeno, 1 Snowling Rd., Uxbridge, Mass. 01569

[21] Appl. No.: 371,838

[22] Filed: Jun. 27, 1989

[51] Int. Cl.[5] ..... A63B 71/02

[52] U.S. Cl. ..... 273/428; 102/498; 102/513

[58] Field of Search ..... 273/428, 418; 102/368, 102/395, 498, 502, 513, 529, 401

[56] References Cited

U.S. PATENT DOCUMENTS

| | | | |
|---|---|---|---|
| 3,049,828 | 8/1962 | Mills | 102/502 X |
| 3,117,521 | 1/1964 | Reaves | 102/368 |
| 3,402,665 | 9/1968 | Tarpley, Jr. et al. | 102/368 |
| 3,492,945 | 2/1970 | Filippi | 102/498 |
| 3,733,727 | 5/1973 | Jones et al. | 102/502 X |
| 4,634,606 | 1/1987 | Skogg | 102/502 X |
| 4,656,092 | 4/1987 | Haman et al. | 102/513 X |
| 4,667,601 | 5/1987 | Diamond et al. | 102/368 |
| 4,684,137 | 8/1987 | Armer, Jr. et al. | 273/428 |
| 4,690,061 | 9/1987 | Armer, Jr. et al. | 102/401 |

*Primary Examiner*—Paul E. Shapiro
*Attorney, Agent, or Firm*—Leon Gilden

[57] ABSTRACT

A war game marking grenade is set forth including an elongate elliptical housing with a central cylindrical well directed therein coaxially with the major axis of the housing with a piercing mechanism to pierce an enclosed gas cylinder and direct the gas from the cylinder into channels and impel gelatin enclosing fluid marking spheres exteriorly of the grenade for marking purposes.

10 Claims, 1 Drawing Sheet

FIG. 1
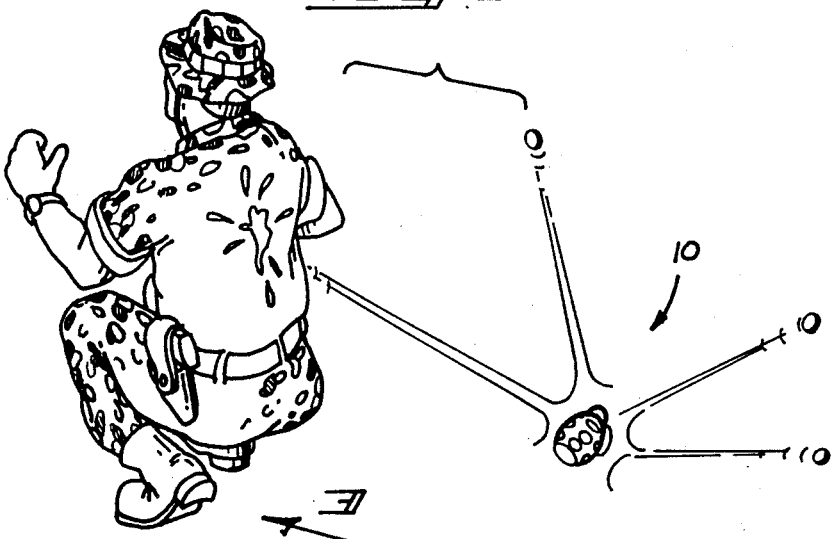
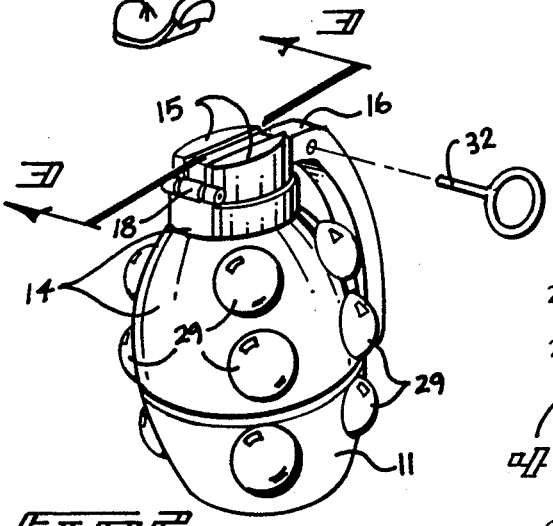
FIG. 2
FIG. 3
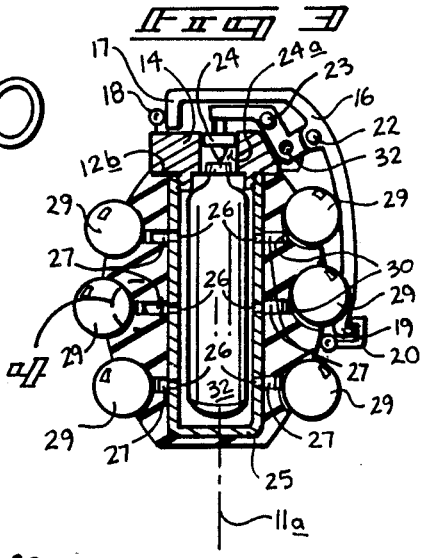
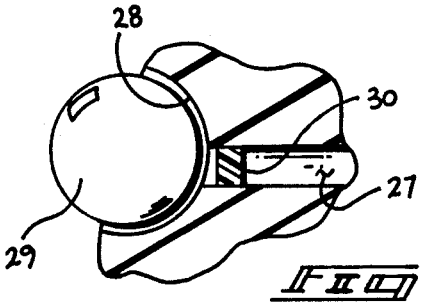
FIG. 4

WAR GAME MARKING GRENADE

BACKGROUND OF THE INVENTION

1. Field of the Invention

The field of invention relates to war game devices, and more particularly pertains to a new and improved war game marking grenade wherein the same utilizes a main body housing and an enclosed gas cylinder to hurtle fluid marking spheres exteriorly of the housing for marking purposes.

2. Description of the Prior Art

The use of war game devices of various types has been developed in the prior art to accommodate the sport of war games wherein individuals indicate casualties and the like by the imparting of a marking fluid upon an opposing party of individuals. An example of such a device may be found in the prior art to include U.S. Pat. No. 4,634,606 to Skogg wherein the marking fluid of specific composition is presented as commonly used in the prior art within a gelatin capsule suitable for use in sports and game exercises.

U.S. Pat. No. 3,049,828 to Mills utilizes a toy gun with a dummy bullet ammunition utilizing vegetable matter within the bullet.

U.S. Pat. No. 4,667,601 to Diamond sets forth a launchable aerosol grenade forcibly ejected by the use of pressurized gas medium.

U.S. Pat. No. 4,690,061 to Armer sets forth a land mine for use in a war game forum wherein pressurized gas upon its release will impel a slurry of marking material onto an opposing individual.

U.S. Pat. No. 4,684,137 to Armer utilizes a storage container and a frangible container utilizing marking fluid for imparting upon an imposing force in a war game scenario for indication of contact with the opposing force or party.

As such, it may be appreciated that there is a continuing need for a new and improved war game marking grenade wherein the same addresses both the problems of ease of use and effectiveness in construction, and in this respect the present invention substantially fulfills this need.

SUMMARY OF THE INVENTION

In view of the foregoing disadvantages inherent in the known types of war game devices now present in the prior art, the present invention provides a war game marking grenade wherein the same utilizes gelatin capsules enclosing a marking fluid for imparting the capsules onto an enemy upon actuation of a pressurized medium. As such, the general purpose of the present invention, which will be described subsequently in greater detail, is to provide a new and improved war game marking grenade which has all the advantages of the prior art war game devices and none of the disadvantages.

To attain this, the present invention comprises a war game marking grenade wherein the same includes an elliptical housing provided with a planar bottom and top surface wherein the top surface utilizes a head with a lever mechanism that is normally maintained adjacent the housing, whereupon pivoting of the lever by removal of a lock pin enables the lever to be pivoted forwardly and puncture a gas cylinder secured within a well that is positioned within the housing aligned with the major axis of the elliptical housing. The well includes a series of apertures that are in turn aligned with channels that are in communication with semi-cylindrical cavities formed on an exterior surface of the housing. The gelatin capsules are adherably mounted within the cavities and upon adequate pressure developing within the well and the associated channels, the capsules are hurtled exteriorly of the housing for marking purposes.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved war game marking grenade which has all the advantages of the prior art war game devices and none of the disadvantages.

It is another object of the present invention to provide a new and improved war game marking grenade which may be easily and efficiently manufactured and marketed.

It is a further object of the present invention to provide a new and improved war game marking grenade which is of a durable and reliable construction.

An even further object of the present invention is to provide a new and improved war game marking grenade which is susceptible of a low cost of manufacture with regard to both materials and labor, and which accordingly is then susceptible of low prices of sale to the consuming public, thereby making such war game marking grenades economically available to the buying public.

Still yet another object of the present invention is to provide a new and improved war game marking grenade which provides in the apparatuses and methods of the prior art some of the advantages thereof, while simultaneously overcoming some of the disadvantages normally associated therewith.

Still another object of the present invention is to provide a new and improved war game marking grenade wherein the same utilizes gelatin spheres secured in a first position adjacent a housing and directed exteriorly of the housing in a second position upon actuation of an enclosed pressurized cylinder.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of the instant invention utilizing a war game forum.

FIG. 2 is an isometric illustration of the instant invention.

FIG. 3 is a cross-sectional view taken along the lines 3—3 of FIG. 2 in the direction indicated by the arrows.

FIG. 4 is an orthographic view of section 4, somewhat expanded, as set forth in FIG. 3.

DESCRIPTION OF THE PREFERRED EMBODIMENT

With reference now to the drawings, and in particular to FIGS. 1 to 4 thereof, a new and improved war game marking grenade embodying the principles and concepts of the present invention and generally designated by the reference numeral 10 will be described.

More specifically, it will be noted that the war game marking grenade apparatus 10 essentially comprises an elongate elliptical housing 11 defined by a major elliptical axis 11*a* formed with a planar bottom surface 12 oriented orthogonally relative to axis 11*a* and parallel to a top surface 13. A cylindrical head 14 is mounted upon the top surface 13 and includes guide flanges 15 with planar confronting surfaces spaced apart a distance equal to a predetermined width defined by a pivotal actuator handle 16. The actuator handle 16 is of a generally "L" shaped configuration with a forward downwardly disposed leg 17 integrally secured to a pivot hinge 18 mounted at a forward edge of the top surface 13. A rear terminal edge of the actuator handle 16 includes an outwardly extending locking gear 19 cooperating with an "L" shaped latch 20 that is pivotally mounted to the housing 11 and cooperates with the locking gear 19 in a first position and is removed from contact with the locking gear 19 in a downwardly pivoted second position. The actuator handle 16 is operably associated with a generally "S" shaped link 21 pivotally mounted to an interior surface of the actuator handle 16 at a rear terminal edge of the link 21 wherein the first pivot 22 is generally aligned with an upper surface of the cylindrical head 14. A second pivot 23 is mounted medially of the "S" shaped link 21 and the second pivot 23 pivotally mounts the "S" shaped link 21 to the cylindrical head 14. A forwardly pointed piercing head 24 is integrally mounted adjacent a forward terminal end of the link 21 and is slidably mounted within a cylindrical well 25. The piercing head 24 includes a rear diameter portion to sealingly cooperate with the cylindrical well 25 to prevent discharge of compressed gas upon piercing of an associated compressed gas cartridge 31 contained within a cylindrical well 25. The cylindrical well 25 is directed interiorly and coaxially of the axis 11*a* and includes a matrix of well orifices 26 directed orthogonally relative to the well 25 wherein orifices 26 cooperate and are aligned with channels 27 formed within the housing 11. The channels 27 terminate in semicylindrical cavities 28 that are formed within the exterior surface of the housing 11. Within the cavities 28, gelatins spheres 29 enclosing a marking fluid therewithin are mounted within the cavities 28 by an easily sheered adhesive that merely secures the spheres 29 within the respective cavities. Each forward terminal end of each housing channel 27 includes a resilient plug 30. The resilient plug 30 provides a time delay prior to release and an exterior projecting of the cylindrical spheres 29, as the plugs 30 are of a press fit within the respective channels 27 and if an adequate pressure developing therewithin, the spheres 29 are projected exteriorly of the housing 11, as illustrated in FIG. 1. A lock pin 32 is normally maintained and directed through the actuator handle 16 and the housing 14, as illustrated in FIGS. 2 and 3, to normally maintain the actuator handles 16 in a first position, as illustrated in FIG. 3. The lock pin 32 operates in concert with the "L" shaped latch 20 as a safety mechanism for the apparatus.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A war game marking grenade comprising, an elongate housing including a plurality of cavities formed in the exterior surface of the housing, and a head portion fixedly mounted to an upper end of the housing including an actuator handle pivotally mounted to a forward upper portion of the head portion, and a piercing head mounted to a lever member wherein the lever member is pivotally mounted to the handle, and a cylindrical well positioned medially of the housing including a gas cylinder container therein with an upper end aligned with a forward end of the piercing head, and each of the cavities in communication with the well, and each of the cavities including a marking fluid containing capsule secured therein whereupon pivoting of the actuator handle directs the piercing head to effect release of a compressed gas contained within the gas cylinder to direct the capsules exteriorly of the housing.

2. A war game marking grenade as set forth in claim 1 wherein the actuator handle is of a generally "L" shaped configuration including a forward downwardly depending leg integrally secured to a pivot hinge, the pivot hinge integrally secured to an upper forward edge of the housing portion.

3. A war game marking grenade as set forth in claim 2 wherein the lever member is of a generally "S" shaped configuration and is pivotally mounted to the actuator handle at a rear terminal end thereof at a first pivot, and the lever member is pivotally mounted to the head portion rearwardly of a forward terminal end of the lever member, and the piercing head is integrally secured to the lever member adjacent the forward terminal end of the lever member.

4. A war game marking grenade as set forth in claim 3 wherein the lever member includes a through-extending aperture aligned with an aperture formed within the housing member, and an elongate lock pin is removably mounted to the lever member and the housing member to prevent pivoting of the lever member prior to removal of the lock pin.

5. A war game marking grenade as set forth in claim 4 including an "L" shaped latch member pivotally mounted to an exterior surface of the housing and cooperating with a locking gear fixedly mounted to a rear terminal end of the actuator handle wherein the latch member maintains the actuator handle adjacent the housing member prior to disengagement of the latch member relative to the locking gear.

6. A war game marking grenade as set forth in claim 5 wherein the elongate housing is of an elliptical configuration including a major axis, and the cylindrical well is coaxially aligned with the major axis.

7. A war game marking grenade as set forth in claim 6 wherein the cylindrical well in communication with each cavity includes an aperture formed in the well wherein each aperture is in communication with a channel formed through the housing, and wherein each channel is in communication with each cavity.

8. A war game marking grenade as set forth in claim 6 wherein each cavity is of a semi-cylindrical configuration, and each capsule is formed as a cylindrical capsule.

9. A war game marking grenade as set forth in claim 8 wherein a forward terminal end of each channel within the housing adjacent each cavity includes a resilient plug therein, wherein each plug is removably mounted within the channel whereupon release of the compressed gas a predetermined pressure will be developed interiorly of the housing to enable discharge of each resilient plug and each respective cylindrical capsule.

10. A war game marking grenade as set forth in claim 9 wherein the piercing head cooperates within a head channel formed through the head portion and the sealing head is in sealing engagement with the head channel.

* * * * *